United States Patent [19]

Crowell et al.

[11] 4,122,628

[45] Oct. 31, 1978

[54] THREE DIMENSIONAL DOLL

[76] Inventors: Florence S. Crowell, Box 125, Lake Toxaway, N.C. 28747; Janice R. Hicks, Rte. 2, Box 20A, Lake Toxaway, N.C. 28749

[21] Appl. No.: 722,279

[22] Filed: Sep. 10, 1976

[51] Int. Cl.[2] ..... A63H 3/06; A63H 3/44

[52] U.S. Cl. ..... 46/135 R; 46/151; 46/156

[58] Field of Search ..... 46/135 R, 156–158

[56] References Cited

U.S. PATENT DOCUMENTS

| | | | |
|---|---|---|---|
| 3,316,669 | 5/1967 | Nachbar | 46/DIG. 1 |
| 3,789,547 | 2/1974 | Chemarin | 46/151 |
| 3,889,414 | 6/1975 | Whetzel | 46/158 |

FOREIGN PATENT DOCUMENTS

| | | | |
|---|---|---|---|
| 423,200 | 1/1935 | United Kingdom | 46/DIG. 1 |

*Primary Examiner*—Louis G. Mancene
*Assistant Examiner*—Robert F. Cutting
*Attorney, Agent, or Firm*—Bailey, Dority & Flint

[57] ABSTRACT

A three dimensional figure is illustrated wherein looped material extends smoothly across suitable stuffing material acting as a cover therefor and as a fastener member for receiving changeable accessories having hooked underportions acting as a complimentary fastener member.

1 Claim, 5 Drawing Figures

THREE DIMENSIONAL DOLL

BACKGROUND OF THE INVENTION

An important object of the present invention is to provide a versatile three dimensional figure, especially useful as a toy doll, wherein accessories including clothing, facial features, and the like may be readily placed upon and removed from the figure.

A snygenestic effect is produced by the elements of the combination in that the loop carrying member serves as a cover in forming the three dimensional figure as well as a fastener member for positioning the accessories. The hooked portion of the fastener may be carried by the underside of the accessories in discrete areas or co-extensively therewith serving both as accessory and as a complimentary fastener means.

The cover and accessory fastener members possess a looped member as well as a hooked member as embodied in "Velcro" hook and looped portions. More specific information concerning "Velcro" may be obtained from the literature including U.S. Pat. Nos. 2,717,437 and 3,114,951.

Prior uses of "Velcro" include fastener members for various purposes such as illustrated in U.S. U.S. Pat. Nos. 3,316,669 which discloses an educational device such as a doll wherein "Velcro" fastener members are utilized to attach clothing to a flat body member. Here the "Velcro" serves its usual function as a fastener member. Another use of "Velcro" as a fastener in the clothing field is typlified by the disclosure of U.S. Pat. No. 3,405,408 wherein the "Velcro" serves its customary function. "Velcro" has also been utilized in felt boards and in board games wherein the looped portion serves as a fastener extending across the flat area.

Dolls of the three dimensional type having covers are exemplified by U.S. Pat. Nos. 1,916,811 and 3,783,554. In the former, features are removable and replaceable by reason of being gummed on one side, whereas in the latter adhesive means are utilized for attachment of the accessories.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
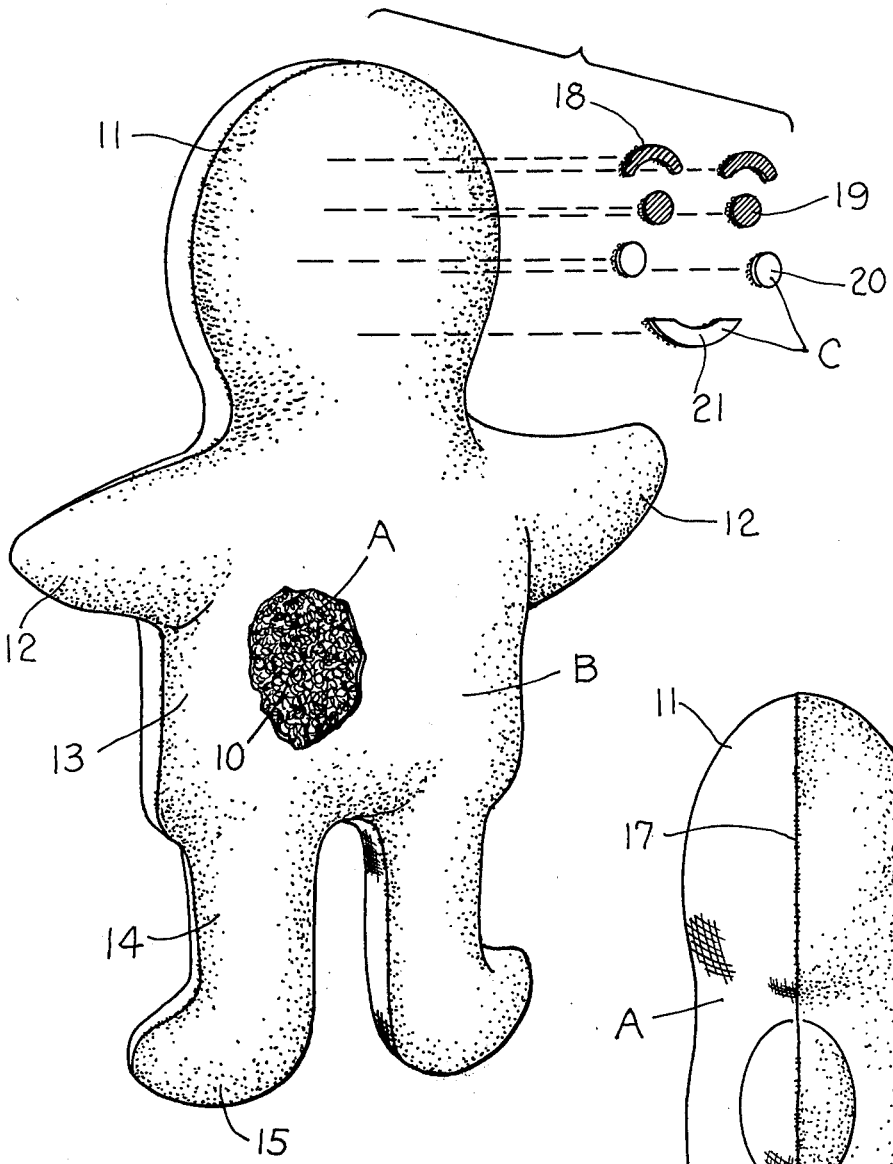
FIG. 1 is a perspective view illustrating a stuffed three-dimensional figure having accessories in the form of facial features constructed in accordance with the present invention.

The drawing illustrates a toy doll comprising a stuffed three dimensional figure A. A cover member B presenting a looped outer surface extends smoothly across the three dimensional figure. Changeable accessories C are receivable upon the looped cover being fastened thereupon by hooked underportions D carried by an undersurface of the accessories. The accessories are removably positionable upon the three dimensional figure by placement of the hooked underportions upon selectable portions of said looped cover member.

Figure 2:
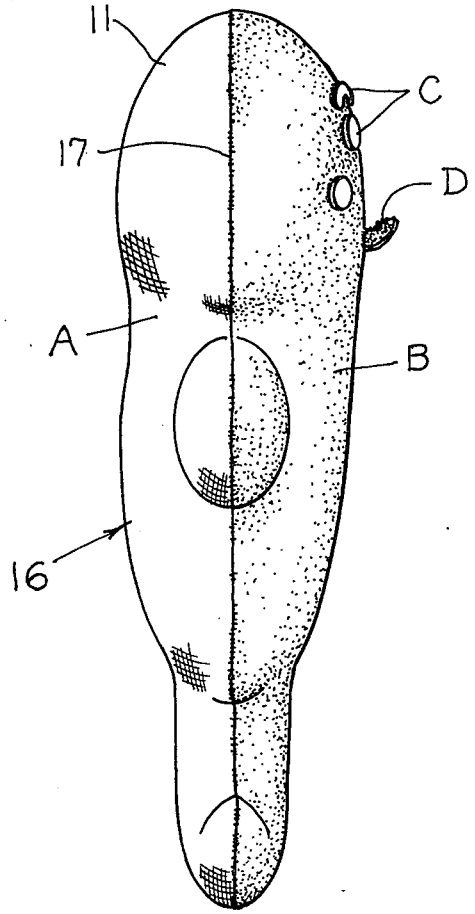
FIG. 2 is a side elevation of the three dimensional toy doll illustrated in FIG. 1.

The stuffed three dimensional figure A includes stuffing material designated at 10 which may be of any suitable preferably cushion-like material such as kapok or plastic foam. The figure includes a head 11, arms 12, a body portion 13, legs 14 and feet 15. As is best observed in FIG. 2, the three dimensional figure A comprises a back cover broadly designated at 16 which may be of any suitable material such as woven textile material which is illustrated as being joined together entirely about the sides of the figure as by stitching 17 with the looped cover member B which extends smoothly across the front portion of the figure. The cover member B, as illustrated, is in the form of a looped portion of the "Velcro" fastener. The cover member B should extend sufficiently extensively as to provide a suitable working area to permit reception of accessories over selected portions thereof.

The changeable accessories C comprise facial features including eye brows 18, eyes 19, cheeks 20, and mouth 21. Such features may, as illustrated, in the form of flannel outer cover members which are backed entirely thereacross by the hooked underportions D. Since the cover portions of these facial features are of flannel material, they are readily adapted to the use of bright ornamental colors.

Figure 5:
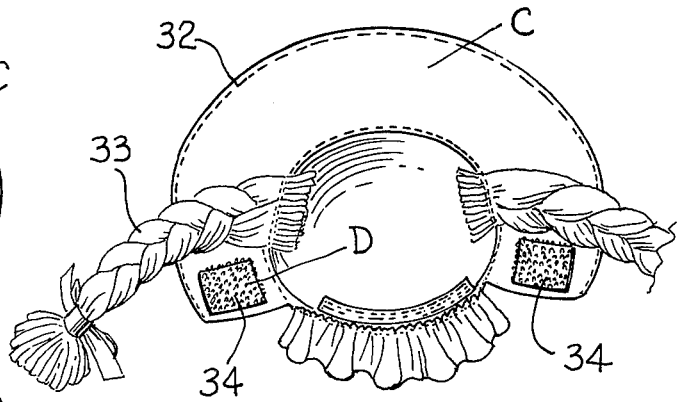
FIG. 5 is a perspective view illustrating accessories such as a cap and hair for the doll being supplied with a hooked underportion.
Figure 4:
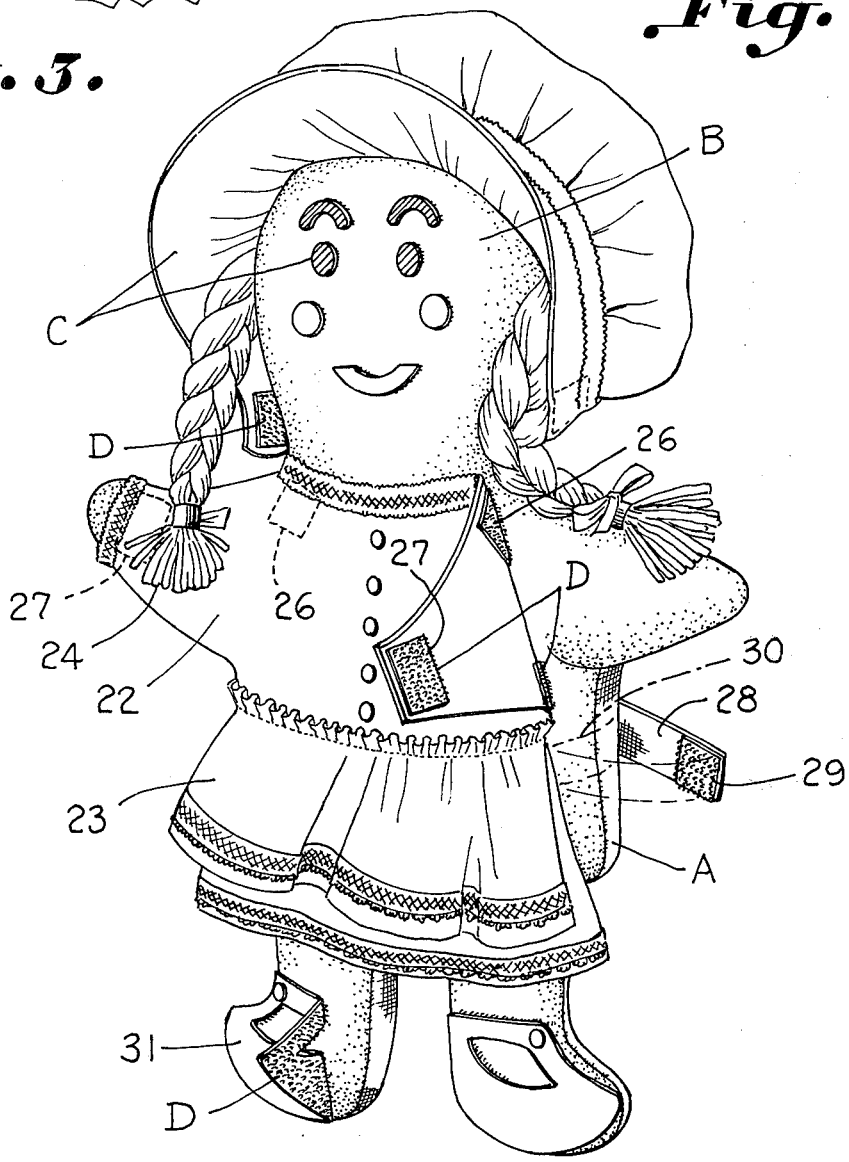
FIG. 4 is a perspective view of a doll constructed in accordance with the invention which is fully clothed and featured.

Other accessories include clothing as best illustrated in FIG. 4. The dress in addition to the top 22 and skirt 23 may include arms 24 and ruffles 25. The hooked underportions may include a pair of spaced discrete areas of "Velcro" adjacent the top as illustrated at 26. "Velcro" hooked underportions may also be provided adjacent the ends of the arm portions as illustrated at 27. Additionally, a strap 28 may be passed about the back of the figure and utilize a "Velcro" underportion 29 which may be secured in the dotted line position as illustrated at 30 so that the hooked underportion may be secured to the looped cover member B. Additional accessories are illustrated in the form of shoes 31 which may comprise a flannel cover with a hooked "Velcro" backing. FIG. 5 illustrates a head 32 and hair piece 33 which are fastened as a unit by hooked underportions which are located in discrete areas as illustrated at 34.

Figure 3:
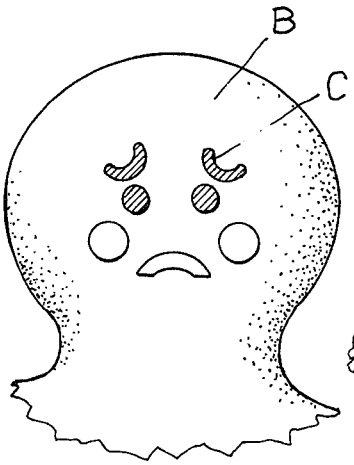
FIG. 3 is a front elevation illustrating a head portion of the figure showing changeable positioning of the facial features to vary expression.

It will be observed that the accessories provide ready access as, for example, to the tiny fingers of children for ready removal and replacement. Facial features may be adjusted as illustrated in FIG. 3 to provide a variety of expression thus varying the appearance of the doll according to the dictates of the user. Such construction is inexpensive and easily manufactured. Also, dolls constructed in accordance with the invention are durable and used over and over to provide a variety of expression and entertainment for the child.

While a preferred embodiment of the invention has been described using specific terms, such description is for illustrative purposes only, and it is to be understood that changes and variations may be made without departing from the spirit or scope of the following claims.

What is claimed is:

1. A doll for which a vaiety of facial features and clothes can be readily changed in a variety of selectable positions for developing and promoting creative skills in children, comprising:

a three dimensional figure of stuffing material including a cover member containing said stuffing material and presenting a looped surface extending smoothly across and covering said three dimensional figure;

a variety of changeable facial feature accessories and a variety of changeable clothing accessories;

hook members carried on a back side of said accessories so that said accessories can be readily secured to said loop surface of said three dimensional figure; and said facial feature accessories and said clothing accessories being removably positionable upon said three dimensional figure by placement of said hook members upon any portion of said cover member;

whereby a child's creative skills are developed and promoted by allowing readily changing of the facial features and clothes of the doll on any desired location of said three dimensional figure selected by the child.

* * * * *